US005479963A

United States Patent [19]

Cheng

[11] Patent Number: 5,479,963

[45] Date of Patent: Jan. 2, 1996

[54] LOOM HEALD HOOK LIFTER

[76] Inventor: Chuan-tien Cheng, 7 Fl., No. 11, Alley 8, Lane 1, Sec. 3, Pao An St., Shulin Chen, Taipei Hsien, Taiwan

[21] Appl. No.: 351,157

[22] Filed: Nov. 30, 1994

[51] Int. Cl.[6] ..... D03C 1/18; D03C 3/32

[52] U.S. Cl. ..... 139/55.1; 139/59; 139/84

[58] Field of Search ..... 139/66 R, 82, 139/83, 84, 91, 57, 71, 59, 65, 88, 79, 85, 67, 68, 455

[56] References Cited

U.S. PATENT DOCUMENTS

| | | | |
|---|---|---|---|
| 3,603,351 | 9/1971 | Piazzolla | 139/57 X |
| 3,888,284 | 6/1975 | Tiernan et al. | 139/57 X |
| 4,285,217 | 8/1981 | Mista et al. | 139/59 X |
| 4,651,784 | 3/1987 | Rambousek et al. | 139/57 |

FOREIGN PATENT DOCUMENTS

| | | | |
|---|---|---|---|
| 2311873 | 1/1977 | France | 139/57 |
| 2545965 | 1/1977 | Germany | 139/88 |

*Primary Examiner*—Andy Falik
*Attorney, Agent, or Firm*—Watson, Cole, Grindle & Watson

[57] ABSTRACT

A loom heald hook lifter includes a horizontal bracket, a plurality of links secured to the horizontal bracket so that the links are not pivotable relative to the horizontal bracket, and a corresponding number of blades each pivotably linked to one of the links. A first hole is defined through a lower tip of each of the links and a second hole is defined in an edge of each of the blades. The blades are respectively pivotally connected to the links by a corresponding number of pintles loosely extending through the holes in the links and frictionally engaging the holes in the blades.

1 Claim, 4 Drawing Sheets

LOOM HEALD HOOK LIFTER

BACKGROUND OF THE INVENTION

1. Field of the Invention

This invention relates to a heald hook lifter.

2. Related Prior Art

A weaving machine includes a plurality of heald hooks each connected between two elastic strings attached to the loom so that the heald hooks, are elastically mounted on the loom. Such heald hooks are disclosed in U.S. Pat. No. 5,095,952. Each of the heald hooks must be moved upwards from time to time during operation of the loom machine. A plastic block is attached to each of the heald hooks. A number of heald hook lifters are mounted on each of a plurality of brackets each connected with a linkage pivotably mounted on the loom. Each of the heald hook lifters includes a blade for abutting against the block attached to a corresponding one of the heald hooks and a link for connecting each of the blades with the bracket. An upper tip of each of the links is secured to the bracket so that each of the links is not pivotable relative to the bracket. Each of the blades is mounted on a corresponding one of the links so that they are not pivotable relative to each other. The heald hooks are movable upwards when the heald hook lifters are movable upwards as the linkage is actuatable. It is desired that each of the blades is movable in a rectilinear path. However, as each of the blades is movable in an arched path, it will be subjected to a bending force as it moves a corresponding one of the heald hooks upwards. The bending forces will produce residue stress in the blades so as to deform the blades, thus biasing the heald hooks from normal positions which results in defects of clothes woven by the loom.

SUMMARY OF THE INVENTION

It is the primary object of this invention to provide a heald hook lifter without residue stress stored therein.

The primary object of this invention to provide a heald hook lifter including a horizontal bracket, a plurality of links linked to the horizontal bracket, and a number of blades each pivotably linked to a corresponding one of the links. A hole is defined through a lower tip of each of links. A hole is defined in an edge of each of the blades. A pintle is loosely inserted through the hole defined through each of the links and forced with frictional engagement with the hole defined in each of the blades.

DETAILED DESCRIPTION OF THE PREFERRED EMBODIMENT

Figure 1:
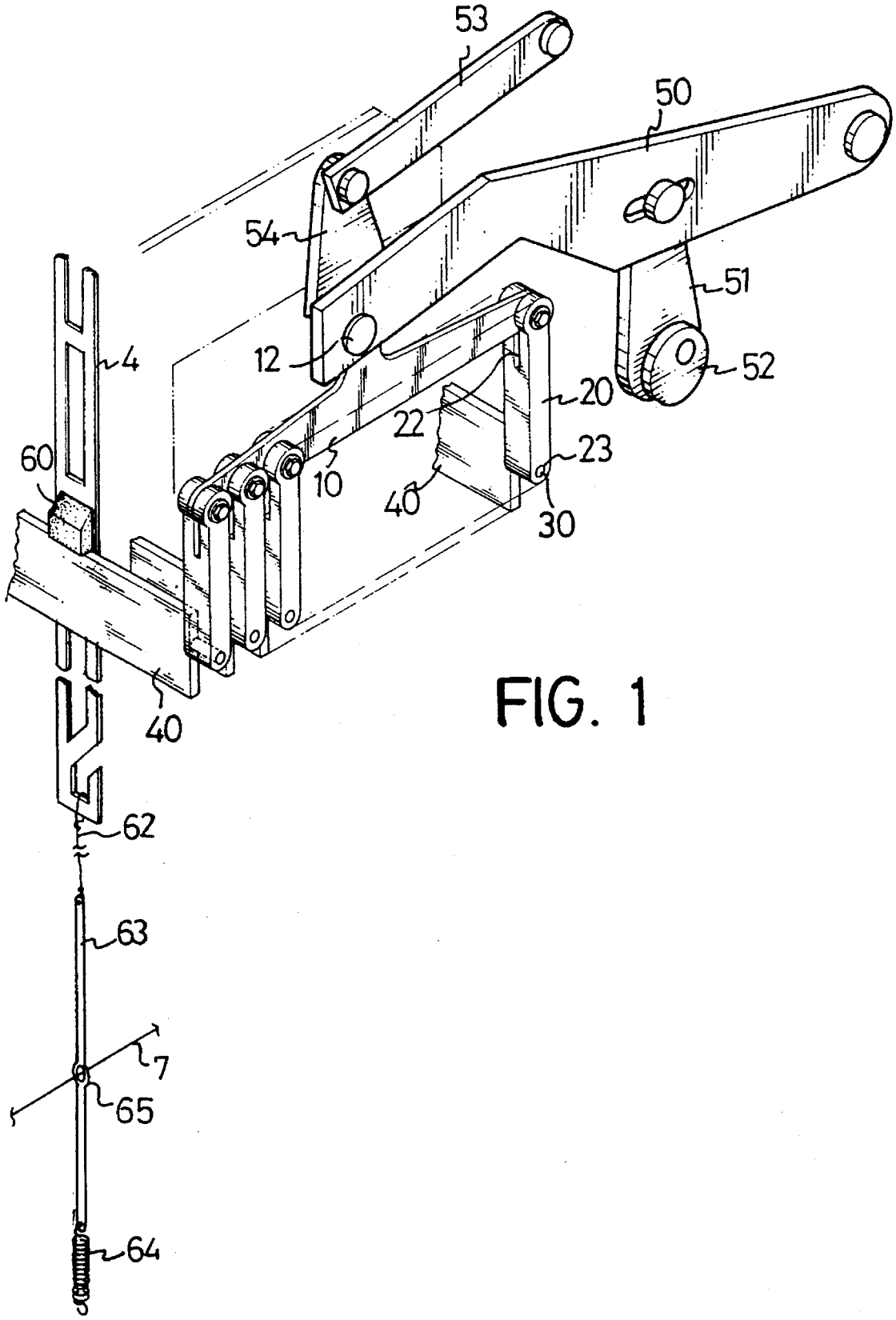
FIG. 1 is an isometric view of the preferred embodiment of the heald hook lifter according to this invention.

Referring to FIG. 1, a loom (not shown) includes a linkage (not numbered) pivotably mounted thereon. The linkage includes a first link 50 with a first tip pivotably linked thereto by means of a pivot (not numbered). A middle portion of the first link 50 is pivotably connected with an upper tip of a second link 51 by means of a pivot (not numbered). A lower tip of the second link 51 is pivotably linked to an eccentric wheel 52 by means of a pivot (not numbered). A second tip of, the first link 50 is pivotably linked to a lower tip of a third link 54 by means of a pivot 12. An upper tip of the third link 54 is pivotably linked to a first tip of a fourth link 53 by means of a pivot (not numbered). A second tip of the fourth link 53 is pivotably linked to the loom by means of a pivot (not numbered). The second tip of the first link 50 will be moved up and down in an arched path as the eccentric wheel 52 is rotated.

A middle portion of a bracket 10 is pivotably linked to the second tip of the first link 50 by means of the pivot 12. An upper tip of each of a plurality of links 20 is linked to the bracket 10 by means of a bolt-and-nut assembly 21 (see FIG. 3). A blade 40 is pivotably linked to a lower tip of each of the links 20 by means of a pintle 30.

A corresponding number of heald hooks 4 are associated with the blades 40, however, only one heald hook 4 is shown for clarity. A block 60 is attached to the heald hook 4 for hooking a cord 62. A heddle 63 is connected between the cord 62 and a spring 64 is attached to the loom. The heddle 63 includes a hole 65 through which a warp 7 is inserted. An upper surface of one of the blades 40 abuts a lower surface of the block 62. The heald hook 4 can be pushed upwards by means of the blade 40 in operation of the linkage. Thus, the warp 7 is pulled upwards so that a shuttle (not shown) can be passed under the warp 7. The heald hooks 4 can be pulled downwards by means of the springs 64.

Figure 2:
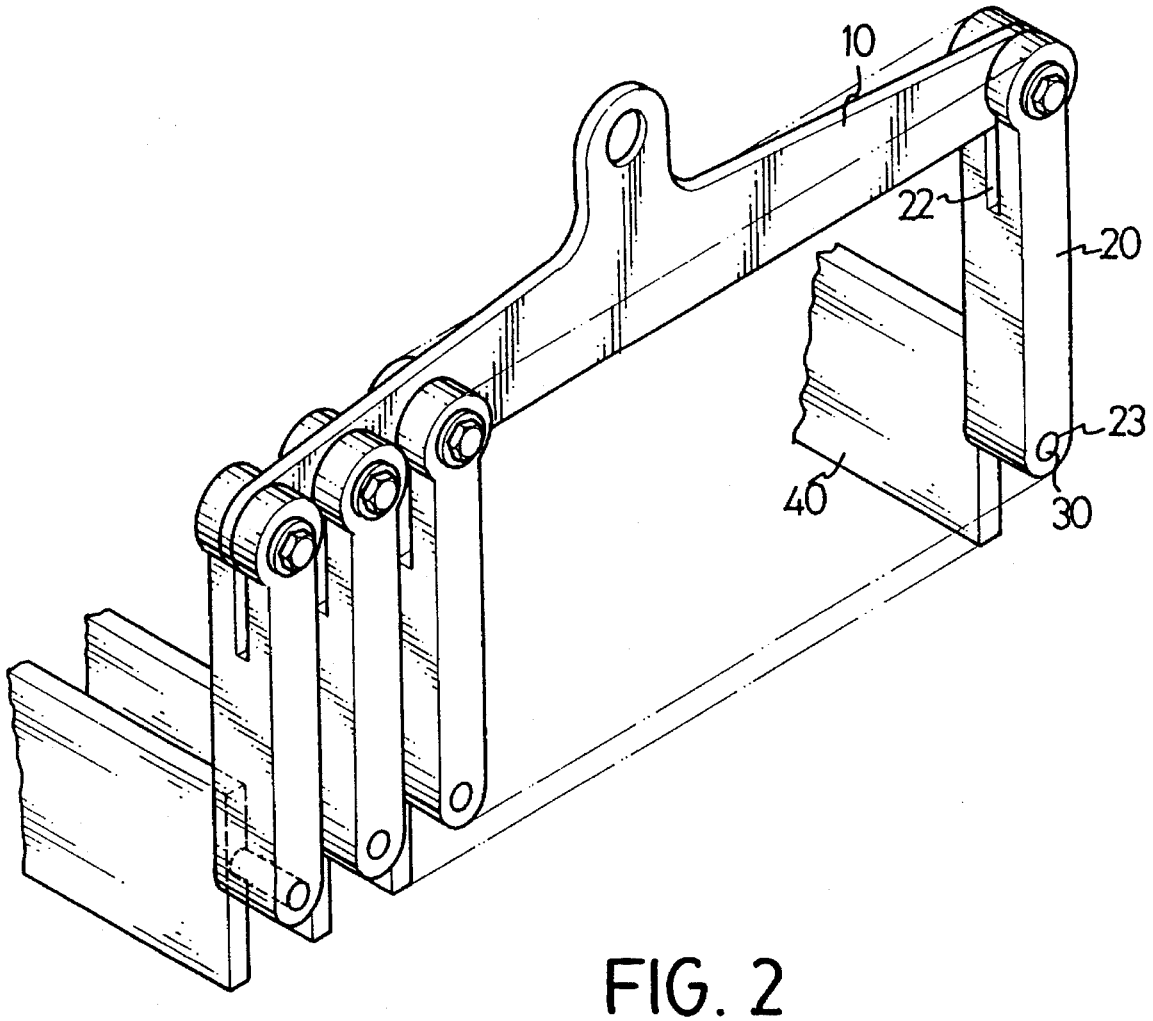
FIG. 2 is a partial view of the heald hook lifter as shown in FIG. 1.

Referring to FIG. 2, a tab (not numbered) projects upwardly from the bracket 10. The tab defines an aperture (not numbered) for receiving the pivot 12.

Figure 3:
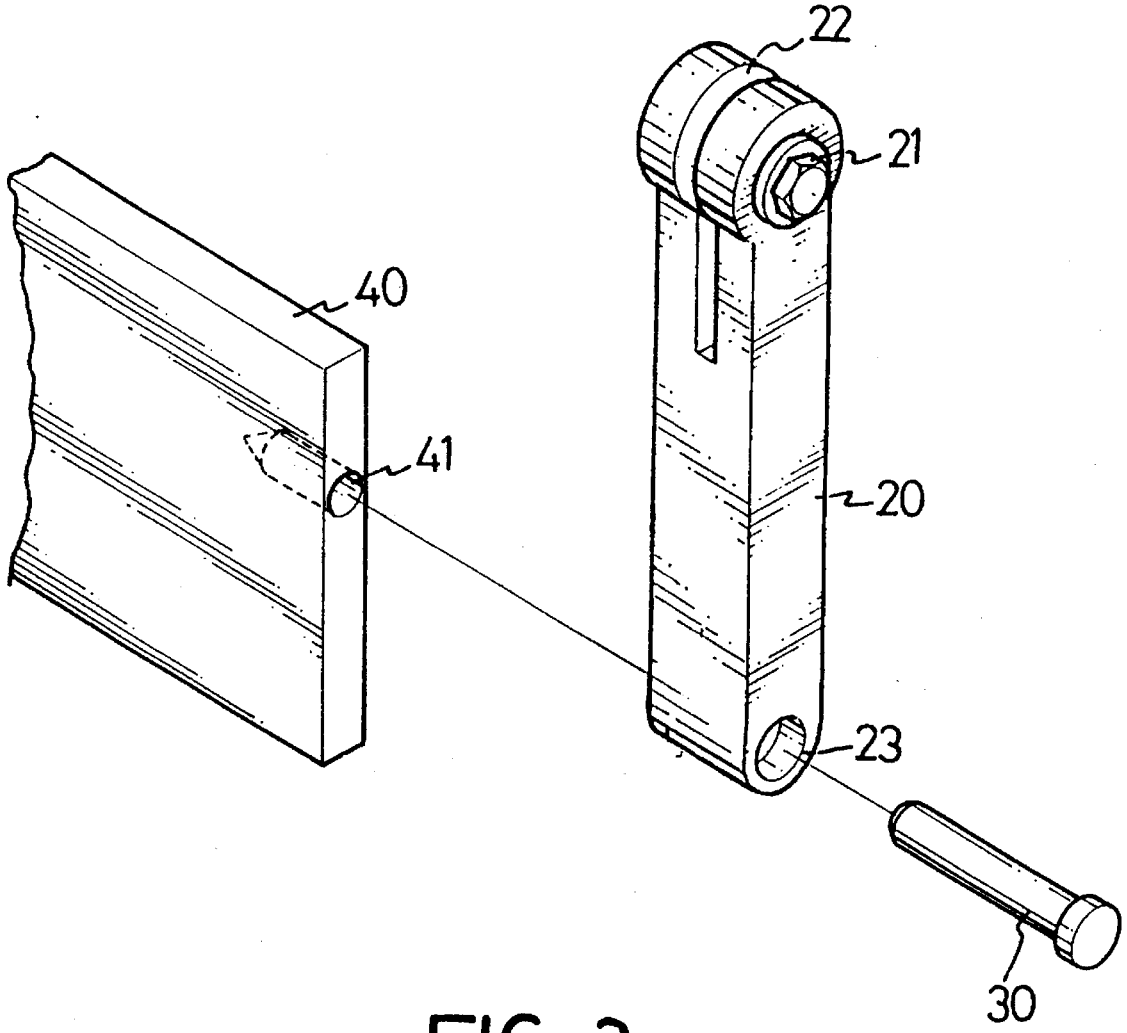
FIG. 3 is an exploded view of a link and a blade of the heald hook lifter as shown in FIG. 2 wherein the link is pivotably connected with the blade.
Figure 4:
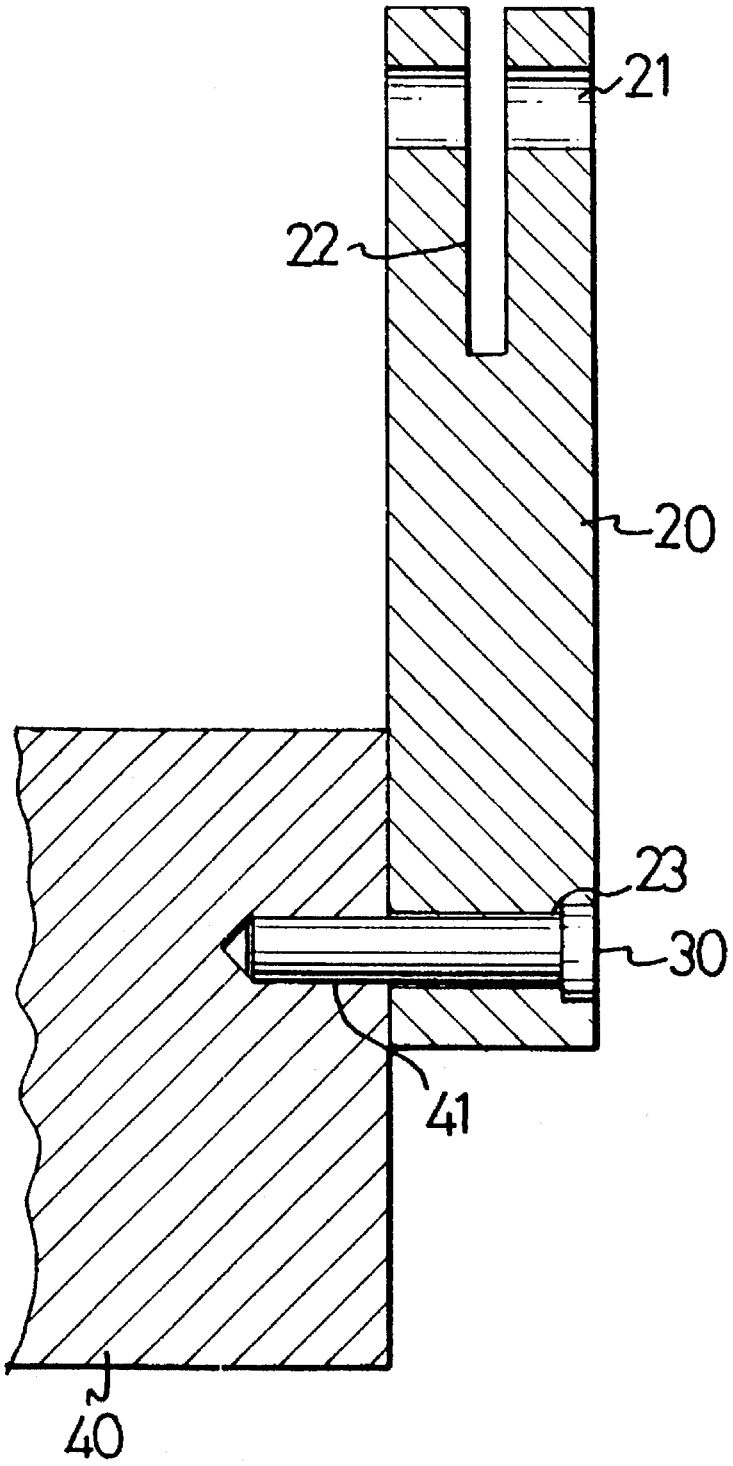
FIG. 4 is a vertical cross-sectional view of the link and the blade as shown in FIG. 3.
Figure 5:
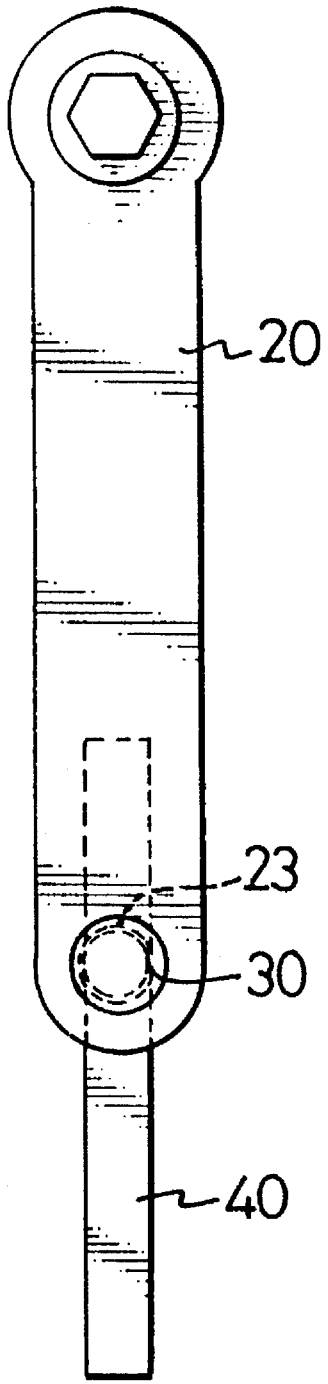
FIG. 5 is a front view of the link and the blade as shown in FIG. 4.

Referring to FIGS. 3–5, an upper tip of each of the links 20 defines a slit 22 for receiving the bracket 10. A lower tip of each of the links 20 defines a through hole 23. Each of the blades 40 is of certain thickness so that it defines a hole 41 into an edge thereof. A pintle 30 includes a head formed on a first tip thereof. The pintle 30 is loosely insertable through the through hole 23. The pintle 30 is rotatable on the link 20 as the diameter of the pintle 30 is smaller than that of the through hole 23. The head of the pintle 30 is not insertable in the through hole 23 as the diameter of the head of the pintle 30 is greater than that of the through hole 23. A second tip of the pintle 30 is forced into frictional engagement with the hole 41 as the diameter of the pintle 30 is equal to that of the hole 41. The pintle 30 is therefore not rotatable relative to the blade 40.

The blades 40 are pivotable on the links 20 when the bracket 10 is movable up and down in the arched path as mentioned above. There will be no residual stress stored in the blades 40 as they are pivotable. Thus, the accumulation of residual stress in the links 20 and the blades 40 is minimized as they are not subjected to torque. Therefore, the life of the loom heald hook lifter according to the invention is increased compared to that of the prior art.

I claim:

1. A weaving machine heald hook lifter comprising:

a bracket;

a plurality of links each including an upper tip linked to the bracket and a lower tip through which a hole is defined;

a corresponding number of blades each including a hole defined in an edge thereof; and means for pivotally interconnecting said links and said blades, respectively;

said means comprising a corresponding number of pintles each loosely extending through the hole defined in each of the links and frictionally engaging the hole defined in each of the blades.

* * * * *